US006851797B2

(12) United States Patent
Suda et al.

(10) Patent No.: US 6,851,797 B2
(45) Date of Patent: Feb. 8, 2005

(54) METHOD OF FILLING RECORDING MATERIAL IN RECORDING MATERIAL CONTAINER AND FILLING APPARATUS

(75) Inventors: Yukiharu Suda, Nagano (JP); Hisashi Koike, Nagano (JP); Noboru Asauchi, Nagano (JP); Koichi Otsuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 98 days.

(21) Appl. No.: 10/338,675

(22) Filed: Jan. 9, 2003

(65) Prior Publication Data

US 2003/0151648 A1 Aug. 14, 2003

Related U.S. Application Data

(63) Continuation-in-part of application No. 10/048,180, filed as application No. PCT/JP01/04490 on May 29, 2001, now abandoned.

(51) Int. Cl.[7] ..... B41J 2/175; B41J 29/393

(52) U.S. Cl. ..... 347/85; 347/19

(58) Field of Search ..... 347/14, 15, 19, 347/84, 85, 86, 87; 399/25, 27, 75, 80, 238, 258, 260

(56) References Cited

U.S. PATENT DOCUMENTS 5,583,549 A * 12/1996 Ujita et al. ..... 347/86
6,158,850 A * 12/2000 Cook ..... 347/85
6,361,138 B1 * 3/2002 Seino et al. ..... 347/19
6,431,448 B1 * 8/2002 Nelson et al. ..... 235/462.13

FOREIGN PATENT DOCUMENTS

JP 2000-94715 4/2000
JP 2001-301198 10/2001

OTHER PUBLICATIONS

JP Office Action for JP 2002–129743 mailed Jun. 25, 2003, Reference No. J0091342.

* cited by examiner

*Primary Examiner*—Anh T. N. Vo
(74) *Attorney, Agent, or Firm*—Sughrue Mion, PLLC

(57) ABSTRACT

An ink filling apparatus is constituted by an access unit (61) for reading an amount of ink consumed in an ink cartridge (10) which needs to be refilled from a storage unit (15) provided on the relevant cartridge and a filling controlling unit (60) for determining an amount of ink on the basis of the data. Ink in an amount corresponding to the amount of ink consumption stored in the storage unit of the ink cartridge (10) is filled by a filling apparatus (66).

13 Claims, 18 Drawing Sheets

FIG. 15

| | CONTENTS OF INFORMATION | |
|---|---|---|
| 501 | DATA ON THE TYPE OF INK CARTRIDGE | 210 |
| 502 | DATA ON THE MANUFACTURING PERIOD | |
| 503 | DATA ON THE MANUFACTURING LINE | |
| 504 | DATA ON THE SERIAL NUMBER | |
| 505 | DATA ON CYAN INK CAPACITY | |
| 506 | DATA ON MAGENTA INK CAPACITY | |
| 507 | DATA ON YELLOW INK CAPACITY | |
| 508 | DATA ON LIGHT CYAN INK CAPACITY | |
| 509 | DATA ON LIGHT MAGENTA INK CAPACITY | |
| 510 | DATA ON THE OPENING PERIOD | 220 |
| 511 | DATA ON THE REMAINING AMOUNT OF CYAN | |
| 512 | DATA ON THE REMAINING AMOUNT OF MAGENTA | |
| 513 | DATA ON THE REMAINING AMOUNT OF YELLOW | |
| 514 | DATA ON THE REMAINING AMOUNT OF LIGHT CYAN | |
| 515 | DATA ON THE REMAINING AMOUNT OF LIGHT MAGENTA | |
| 516 | ORDER PLACEMENT FLAG | |

FIG. 16

| | CONTENTS OF INFORMATION | |
|---|---|---|
| 601 | NUMBERS OF TIMES PERMITTING REPLENISHMENT, REPLACEMENT AND CHANGE | 310 |
| 602 | NUMBERS OF REPLENISHMENT, REPLACEMENT AND CHANGE (CYAN INK) | |
| 603 | NUMBERS OF REPLENISHMENT, REPLACEMENT AND CHANGE (MAGENTA INK) | |
| 604 | NUMBERS OF REPLENISHMENT, REPLACEMENT AND CHANGE (YELLOW INK) | |
| 605 | NUMBERS OF REPLENISHMENT, REPLACEMENT AND CHANGE (LIGHT CYAN INK) | |
| 606 | NUMBERS OF REPLENISHMENT, REPLACEMENT AND CHANGE (LIGHT MAGENTA INK) | |
| 607 | INK TYPE INFORMATION (CYAN INK) | 320 |
| 608 | INK TYPE INFORMATION (MAGENTA INK) | |
| 609 | INK TYPE INFORMATION (YELLOW INK) | |
| 610 | INK TYPE INFORMATION (LIGHT CYAN INK) | |
| 611 | INK TYPE INFORMATION (LIGHT MAGENTA INK) | |
| 612 | EFFECTIVE PERIOD (CYAN INK) | |
| 613 | EFFECTIVE PERIOD (MAGENTA INK) | |
| 614 | EFFECTIVE PERIOD (YELLOW INK) | |
| 615 | EFFECTIVE PERIOD (LIGHT CYAN INK) | |
| 616 | EFFECTIVE PERIOD (LIGHT MAGENTA INK) | |
| 617 | OPERATING SYSTEM INFORMATION | 330 |
| 618 | PRINTER ID | |
| 619 | PRINTER DRIVER INFORMATION | |
| 620 | FIRMWARE INFORMATION | |

METHOD OF FILLING RECORDING MATERIAL IN RECORDING MATERIAL CONTAINER AND FILLING APPARATUS

This is a Continuation-In-Part of application Ser. No. 10/048,180 filed March 22, 2002, now abandoned which is a National Stage Application filed under §371 of PCT Application No. PCT/JP01/04490 filed May 29, 2001; the above noted prior applications are all hereby incorporated by reference.

BACKGROUND OF THE INVENTION

The present invention relates to a technique for filling ink in an ink cartridge of a recording apparatus for effecting printing on a recording medium by ejecting ink droplets through a nozzle opening upon receiving the supply of ink from a replaceable ink cartridge, as well as an apparatus therefor.

For example, an ink-jet type recording apparatus includes a recording head for ejecting ink droplets through a nozzle opening by supplying a drive signal to the piezoelectric vibrator, the heat generating unit, or the like in correspondence with print data, and pressurizing ink in a pressure generating chamber by energy generated by a piezoelectric vibrator, a heat generating unit, or the like, and an ink cartridge for supplying ink thereto.

The print quality is determined by the resolution of the recording head and is greatly influenced by the viscosity of the ink, the degree of blurring on a recording medium, and the like. Therefore, with a view to improving the print quality, efforts have been made to improve the ink characteristics and improve a drive signal to be supplied to the recording head, and efforts have been made to improve maintenance conditions including the period of blank ejection and forcible ejection in a capped state in order to prevent the clogging of the nozzle opening.

Thus, only when not just the ink characteristics but the ink characteristics, the method of driving the recording head and the like are improved as a whole, the print quality of the recording apparatus improves. It may be possible to incorporate the results based on such technological development into ink-jet type recording apparatuses that are newly manufactured. However, in order to apply such technological development to are cording apparatus which has left the manufacturer, it becomes necessary to bring the recording apparatus to the manufacturer and replace its storage unit in which control data is recorded, so that it is almost impossible to do so in the light of such as the cost and trouble.

Therefore, as disclosed in JP-A-5-193127 and the like, a technique has been proposed in which an ink cartridge is provided with a storage unit, and the characteristics of the ink, the amount of ink, driving conditions, and the like are stored in this storage unit, while, on the recording apparatus side, the driving conditions are adjusted in correspondence with these items of information.

Incidentally, as for the ink cartridges which are conventionally discarded as expendables and the cartridges integrated with recording heads as well, there has been a growing need for the manufacturers to collect then as practically as possible so as to strive for the protection of the environment. In conjunction with this need, an attempt has been made to fill the ink into the collected ink cartridges and recycle them. However, collection expenses and the cost of inspection are additionally incurred, so that there is a problem in that the cost of the recycled products increases.

SUMMARY OF THE INVENTION

Accordingly, an object of the invention is to provide a method of filling an ink cartridge and an apparatus therefor, which make it possible to promote the recycling of the ink cartridges and make effective use of resources by effectively utilizing the storage unit attached to the ink cartridge.

Another object of the invention is to provide a method of filling an ink cartridge and an apparatus therefor, which make it possible to promote the recycling of the ink cartridges by allowing end users to actively participate, while effectively utilizing the storage unit attached to the ink cartridge.

In order to solve the aforesaid object, the invention is characterized by having the following arrangement.

(1) A method of filling an ink cartridge provided with a container including an ink chamber for accommodating ink and an ink supply port for discharging the ink in the ink chamber to a recording head, and a storage unit for storing data concerning the ink, comprising the step of:
filling the ink in an ink filling amount corresponding to an amount of ink consumption stored in the storage unit.

(2) The method of filling an ink cartridge according to (1), wherein the ink filling amount is set to be less than an initially filled amount.

(3) The method of filling an ink cartridge according to (1), wherein in a case where the amount of ink remaining in the container is greater than a prescribed value, the ink is filled after the remaining ink is discharged by a predetermined amount.

(4) The method of filling an ink cartridge according to (1), wherein the data concerning the amount of ink of the storage unit is updated in accordance with the amount of ink after filling.

(5) The method of filling an ink cartridge according to (1), wherein selection as to whether the ink is to be added or the ink is to be filled after cleaning the container is made according to a period of time elapsed from a period of manufacture or from a period of previous ink filling which is stored in the storage unit.

(6) The method of filling an ink cartridge according to (1), wherein information on parts constituting the cartridge is written in the storage unit, and a determination as to whether or not replacement of the part is required is made at the time of filling ink on the basis of the information on the parts.

(7) The method of fill ng an ink cartridge according to (1), wherein a determination as to whether or not replacement of the storage unit is required is made in correspondence with an amount of information to be stored in the storage unit.

(8) The method of filling an ink cartridge according to (1), wherein incidental information is newly stored in the storage unit.

(9) The method of filling an ink cartridge according to (1), wherein a determination as to whether or not refilling is possible is made on the basis of a period of time elapsed from the time when the ink in the ink cartridge was consumed.

(10) The method for filling an ink cartridge according to (1), wherein data concerning a working environment in a state in which the ink cartridge is loaded in a recording apparatus is stored in the storage unit, and a determination as to whether or not refilling is possible is made on the basis of the working environment.

(11) The method of filling an ink cartridge according to (1), wherein in a case where the ink is ink containing a pigment, the ink is filled by taking into consideration the degree of precipitation of the pigment.

(12) An apparatus for filling an ink cartridge comprising:
a reading unit for reading out an amount of ink consumed in an ink cartridge from a storage unit provided on the ink cartridge requiring refilling; and controlling unit for determining an amount of ink on the basis of the data.

(13) The apparatus for filling an ink cartridge according to (12), wherein the controlling unit sets an ink filling amount to be less than an initially filled amount.

(14) The apparatus for filling an ink cartridge according to (12), wherein in a case where the amount of ink remaining in the container is greater than a prescribed value, the controlling unit fills the ink after the ink is discharged by a predetermined amount.

(15) The apparatus for filling an ink cartridge according to any one of (12) to (14), wherein the controlling unit updates the data concerning the amount of ink stored in the storage unit according to the amount of ink after filling.

(16) The apparatus for filling an ink cartridge according to (12), wherein the controlling unit makes selection as to whether the ink is to be added or the ink is to be filled after cleaning the container in correspondence with a period of time elapsed from a period of manufacture or from a period of previous ink filling which is stored in the storage unit.

(17) The apparatus for filling an ink cartridge according to (12), wherein on the basis of information on parts constituting the cartridge written in the storage unit, the controlling unit determines whether or not replacement of the part is required.

(18) The apparatus for filling an ink cartridge according to (12), wherein in a case where the ink is ink containing a pigment, the controlling unit fills the ink by taking into consideration the degree of precipitation of the pigment.

(19) The apparatus for filling an ink cartridge according to (12), wherein the controlling unit determines a period of time elapsed from the time when the ink in the ink cartridge was consumed on the basis of the data stored in the storage unit, and determines whether or not refilling is possible on the basis of the elapsed period of time.

(20) The apparatus for filling an ink cartridge according to (1), wherein the controlling unit determines whether or not refilling is possible on the basis of data which is stored in the storage unit and concerns a working environment in a state in which said ink cartridge is loaded in a recording apparatus.

(21) A method of filling a recording material in a recording material container in response to a user's request, comprising the steps of:

receiving the request;

filling the recording material in the recording material container in response to the request; and receiving a counter value corresponding to an amount filled.

(22) A recording material filling apparatus for filling a recording material in an ink cartridge in response to a user's request, comprising:

a recording material container loading unit for loading a refillable recording material container;

a request input unit for inputting the request from an outside; and a recording material filling unit for filling the recording material in the recording material container in response to the request.

(23) The apparatus for filling a recording material container according to (22), wherein the recording material filling unit is arranged to fill the recording material in the recording material container after the recording material remaining in the recording material container is discharged.

(24) The apparatus for filling a recording material container according to (22), wherein after the recording material remaining in the recording material container is discharged, the recording material filling unit fills a recording material of a type different from that of the discharged recording material in the recording material container.

(25) The apparatus for filling an recording material container according to (22), wherein the recording material container is provided with a storage unit for storing working environment information in a state in which the recording material container is loaded in a recording apparatus, wherein the information from the storage unit is displayed on a display unit, the recording material filling unit determines whether or not an recording material of a different type can be used in the recording apparatus on the basis of the working environment information, and a result thereof is displayed on the display unit.

(26) The apparatus for filling a recording material container according to (25), wherein the storage unit stores information for specifying a recording apparatus in which the recording material container is loaded, and the recording material filling unit determines whether or not recording material of a different type can be used in the recording apparatus on the basis of the information for specifying the recording apparatus, and a result of the determination is displayed on a display unit.

(27) The apparatus for filling a recording material container according to (22), wherein the recording material container is provided with a storage unit which stores information for specifying a fillable amount of the recording material, and the recording material filling unit fills the recording material in the recording material container within a range of the fillable amount.

(28) The apparatus for filling a recording material container according to (25), wherein the storage unit stores the number of filling the recording material in the recording material container, and the recording material filling unit determines whether or not the recording material can be filled in the recording material container on the basis of the number of filling prior to the filling of recording material, and the number of filling stored in the storage unit is updated after the filling of the recording material.

(29) The apparatus for filling a recording material container according to (27), wherein the storage unit stores the number of filling the recording material in the recording material container, and the recording material filling unit determines whether or not the recording material can be filled in the recording material container on the basis of the number of filling prior to the filling of recording material, and the number of filling stored in the storage unit is updated after the filling of the recording material.

(30) The apparatus for filling a recording material container according to (22), wherein the request includes filling amount information for specifying a recording material filling amount which has been arbitrarily set by said user, and the recording material filling unit fills the recording material in the recording material container in accordance with the filling amount information.

(31) A recording material filling apparatus for filling a recording material in a container in response to a user's request, comprising:

the recording material filling apparatus according to any one of (22) to (30); and a server system for effecting at least one of management of an amount of recording material to be filled in the recording material filling apparatus, upgrading of data on a recording material provision fee, and provision of support information for allowing the recording material filled in the cartridge to be usable in a recording apparatus.

(32) The method according to (21), wherein the recording material container is one of an ink cartridge and a toner cartridge.

(33) The apparatus according to (22), wherein the recording material container is one of an ink cartridge and a toner cartridge.

In The present disclosure relates to the subject matter contained in Japanese patent application Nos. 2000-157564 (filed on May 29, 2000) and 2000-321293 (filed on Oct. 20, 2000), which are expressly incorporated herein by reference in their entireties.

BRIEF DESCRIPTION OF THE DRAWINGS

FIGS. 15 and 16 are schematic diagrams respectively illustrating data stored in the storage unit attached to the cartridge;

DETAILED DESCRIPTION OF PREFERRED EMBODIMENTS

The present invention will be described hereinafter with employing an ink cartridge as an example, and is not limited to the ink cartridge.

Figure 1:
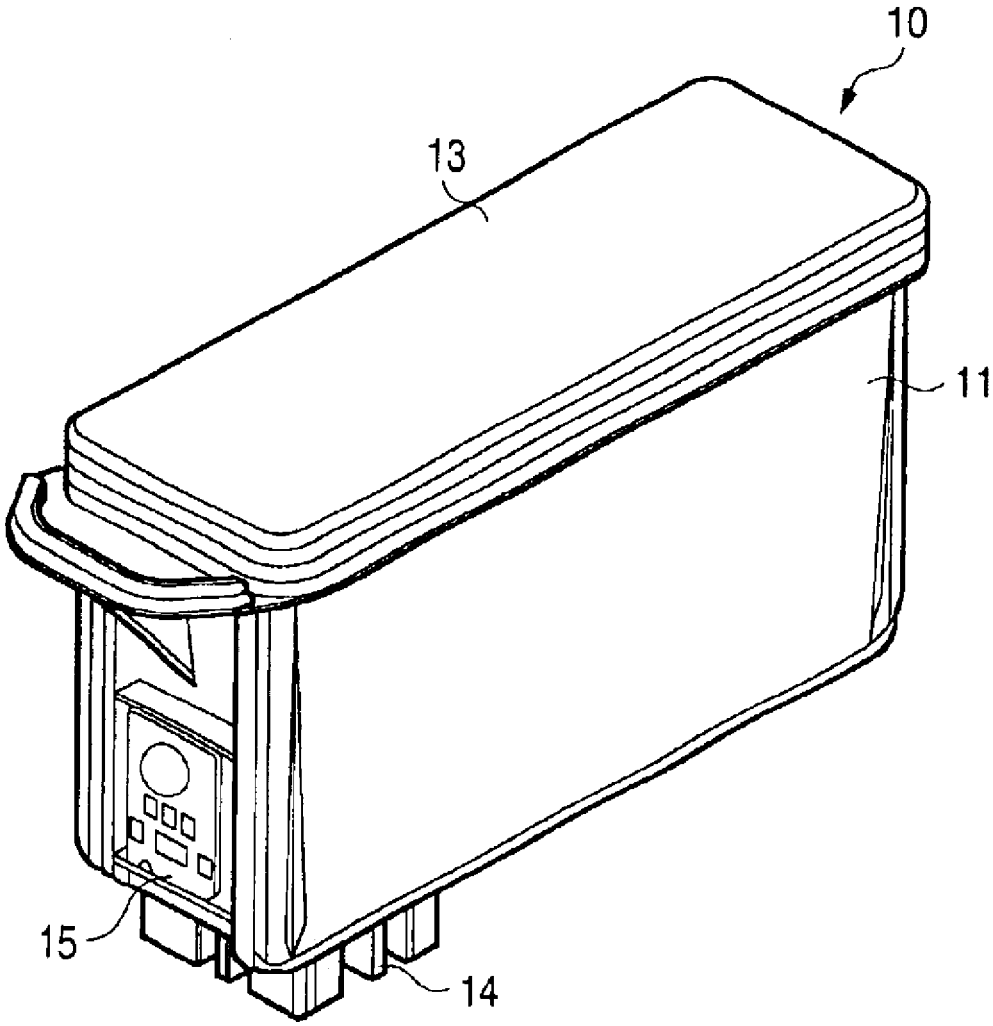
FIG. 1 is a diagram illustrating an embodiment of a cartridge for a black ink to which the ink filling technique in accordance with the invention is applied.

FIG. 1 illustrates an embodiment of an ink cartridge 10 for black, which is one kind of a recording material container for receiving recording material, and the cartridge for a black ink is constituted such that a porous member 12 (see FIG. 5) is preferably accommodated in a container 11 and is impregnated with ink, and an upper surface is closed by a cover 13. An ink supply port 14, which is airtightly engaged with an ink supplying needle 44 when the ink cartridge is loaded on a carriage 42, is formed in a bottom surface of the container 11, and a storage unit 15 is fixed to one side surface of the container 11.

Figure 2A:
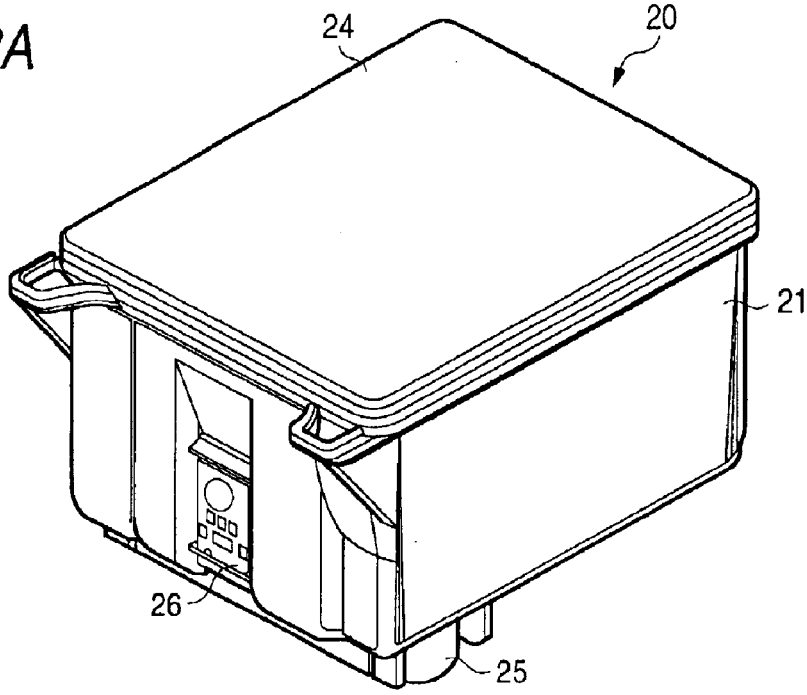
FIGS. 2(*a*) and 2(*b*) are diagrams respectively illustrating an embodiment of a cartridge for color inks to which the ink filling technique in accordance with the invention is applied, in which FIG. 2(*a*) illustrates a state in which the cartridge is closed by a cover, and FIG. 2(*b*) illustrates a state in which the cover is removed.
Figure 2B:
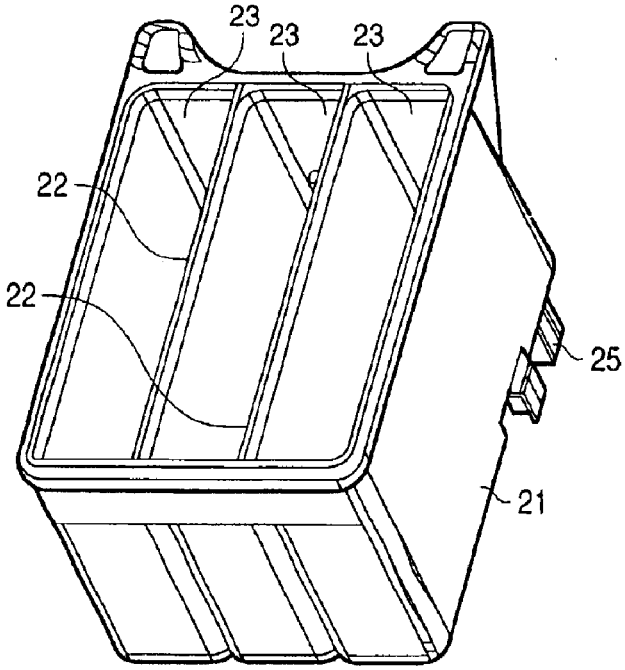

FIGS. 2(*a*) and 2(*b*) respectively show an embodiment of a cartridge 20 for color inks. The cartridge for color inks is constituted such that a container 21 is divided into a plurality of chambers 23 by partition walls 22, porous members are respectively accommodated in the chambers 23, and the porous members, which are similar to the porous member 12 for the cartridge 10 for a black ink, are respectively impregnated with inks of different colors, and an upper surface is closed by a cover 24. Ink supply ports 25, which are airtightly engaged with ink supplying needles 45, respectively, when the ink cartridge is loaded on the carriage 42, is formed in a bottom surface of the container 21, and a storage unit 25 is fixed to one side surface of the container 21.

Figure 3A:
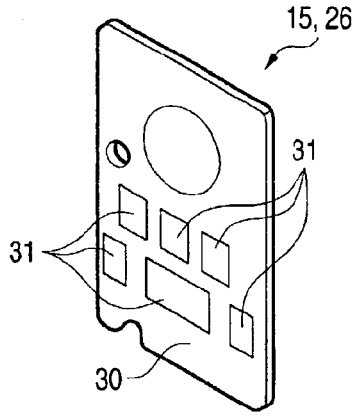
FIGS. 3(*a*) and 3(*b*) are diagrams illustrating an embodiment of a storage unit provided on the ink cartridge.
Figure 3B:
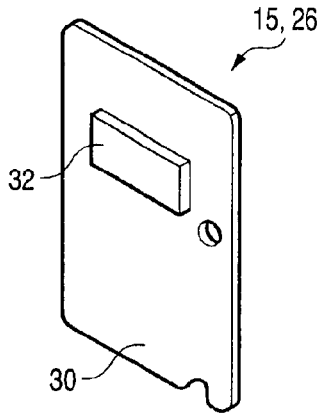

As shown in FIG. 3, in the respective storage unit 15 and 26 of the ink cartridge 10 for black and the cartridge 20 for color inks, contacts 31 for establishing contact with a recording apparatus are formed on the surface of a board 30 which becomes an obverse surface when the storage unit 15 and 26 are attached to the ink cartridges 10 and 20. Further, a semiconductor storage unit 32 is accessibly mounted at a position where it does not cause a hindrance to the formation of contacts, i.e., on a reverse surface of the circuit board 30 in this embodiment.

In addition to storing fixed data such as the date of manufacture, durable years, and the number of refillable times, the semiconductor storage 32 is adapted to be able to store the following in such a manner as to be capable of storing them in a rewritable manner as required in predetermined regions:

(1) the amount of ink of each color, (2) the number of refilling the ink cartridge, (3) the state of maintenance, including the state of cleaning at the time of the refilling of the ink cartridge, the state of parts replacement, and the like, and (4) the state of use, including the time of final use of the ink cartridge, the time of a final ink end, the working environment of the ink cartridge, and the like.

Figure 4:
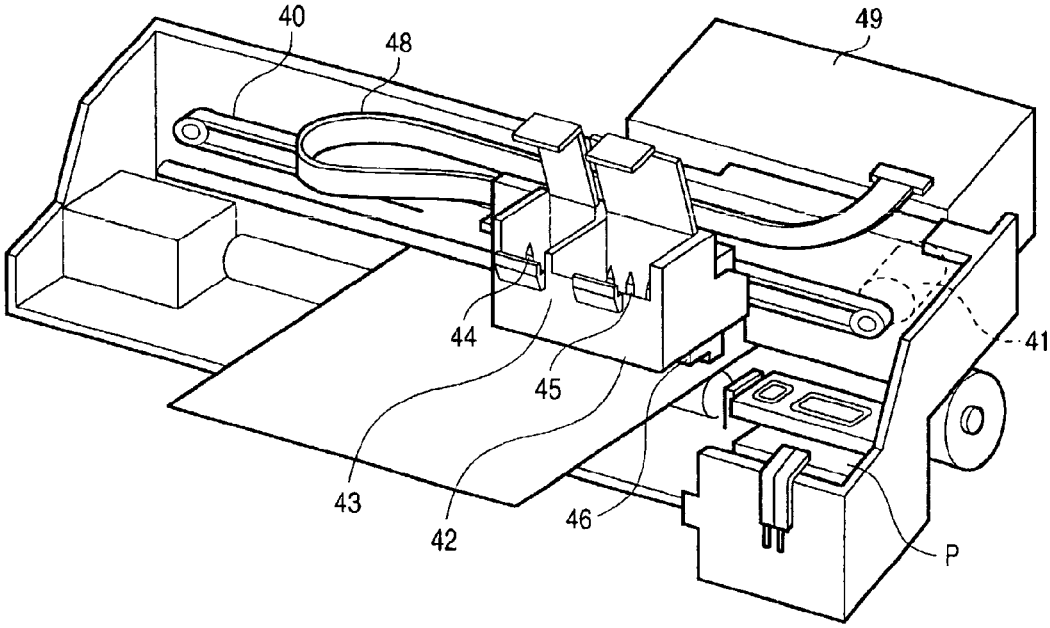
FIG. 4 is a diagram illustrating a printing mechanism section in accordance with an example of a recording apparatus using the ink cartridge.

FIG. 4 shows a printing mechanism section in accordance with an embodiment of the recording apparatus, in which, the carriage 42, connected to a drive motor 41 through a timing belt 40, is formed with, on its upper surface, a holder 43 which is capable of accommodating the cartridge 10 for a black ink and the cartridge 20 for color inks, and is provided with, on its lower surface, the ink supplying needles 44 and 45 for connection to the respective cartridges 10 and 20 and a recording head 46 for ejecting droplets of the black ink and droplets of the color ink through the ink supplying needles 44 and 45 upon receiving the supply of the ink from the cartridges 10 and 20.

Figure 5:
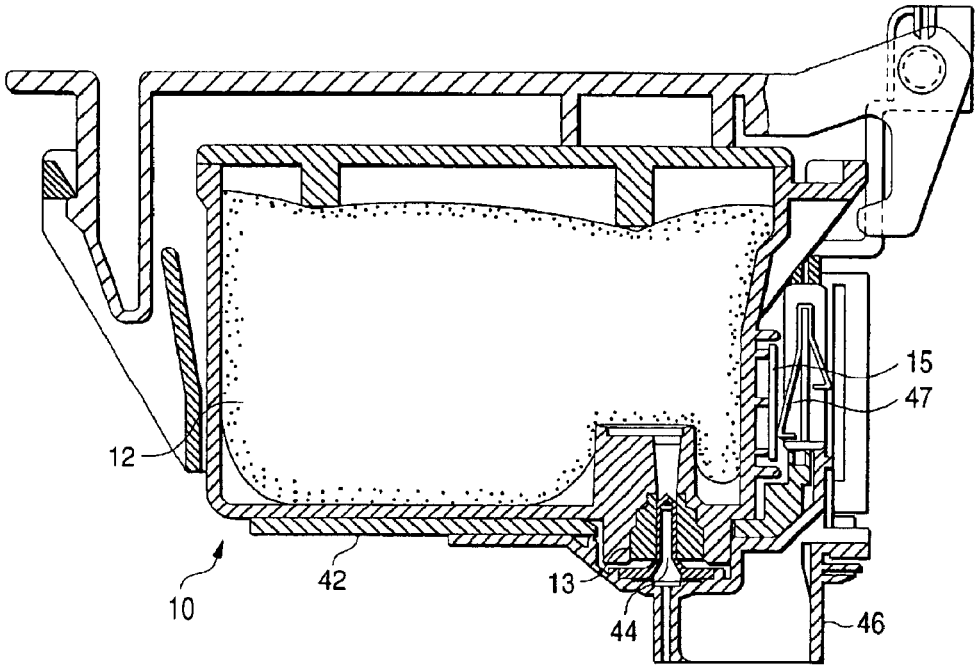
FIG. 5 is a cross-sectional view illustrating a state in which the cartridge for a black ink is loaded on a carriage.

FIG. 5 shows a cross-sectional structure illustrating a state in which the ink cartridge is loaded by taking the cartridge 10 for the black ink as an example. In the state in which the ink cartridge 10 is properly fitted to the ink supplying needle 44, the contacts 31 of the storage unit 15 establishes contact with contacts 47 of the carriage 42, so that access from a controller 49 through a flexible cable 48 becomes possible.

Figure 6:
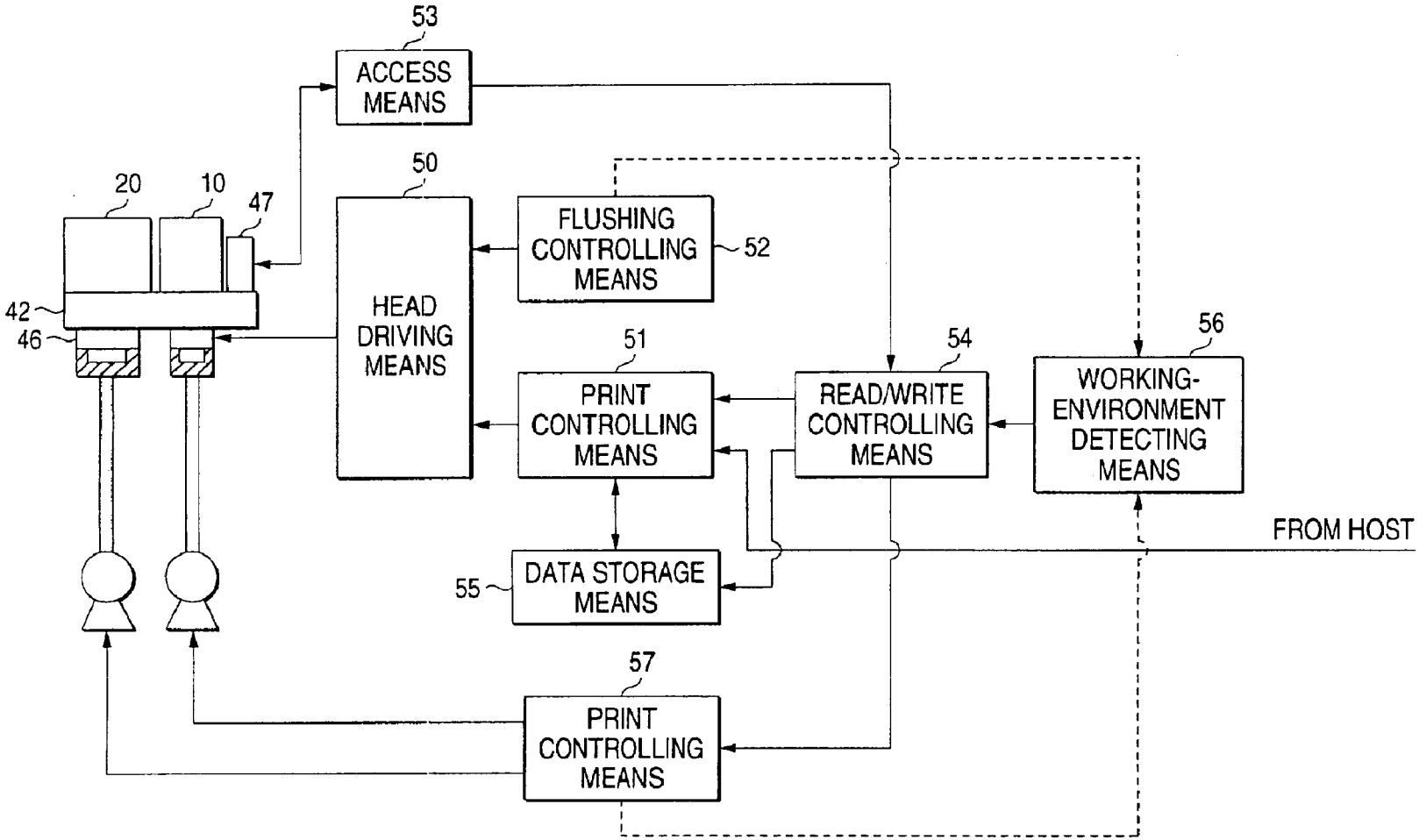
FIG. 6 is a block diagram illustrating an embodiment of a controller for controlling the operation of the apparatus.

FIG. 6 shows an embodiment of the controller 49, in which a head driving unit 50 causes ink droplets to be ejected from the recording head 46 on the basis of an instruction from a print controlling unit 51 in response to a signal from a host or an instruction from a flushing controlling unit 52 for overcoming clogging.

The print controlling unit 51 reads out optimized driving conditions stored in the storage unit 15 and 26 of the ink cartridges 10 and 20 through an access unit 53, and executes print control. Consequently, even in the case of a recycled product which has been refilled as will be described later, it is possible to adjust a drive signal to the recording head 46 so as to eject ink as ink droplets suitable for printing.

The controller 49 measures the amount of ink discharged for the printing operation, the prevention of clogging, and the like on the basis of the number of ink droplets, the period of driving and the number of revolution of a pump unit P for supplying negative pressure to the recording head 46, and so on, and updates data stored in the storage unit 15 and 26 of the respective cartridges 10 and 20 through a read/write controlling unit 54 at a predetermined period, e.g., at a point of time when the printing of a series of print data has been finished, or at a point of time when the turning off of the power has been instructed by a software switch.

It should be noted that, in the case of the cartridge 20 for color inks, the amount of ink consumption is measured by being distinguished for each type of ink of the respective color, and its amount of consumption or the remaining amount is stored in the storage unit 26 by being distinguished for each color.

The read/write controlling unit 54 writes in the storage unit 15 and 26 of the ink cartridges 10 and 20 data in a data storage unit 55 which stores data on the working environment of the recording apparatus detected by a working-environment detecting unit 55, the number of flushing operation by the flushing controlling unit 52, and the number of cleaning operation by a cleaning controlling unit 56 as well as the amounts of consumption of the ink of the respective colors at a predetermined period, e.g., at a point of time when the printing of a series of print data has been finished, or at a point of time when the turning off of the power has been instructed by the software switch.

Next, when the ink cartridges 10 and 20 thus constituted are loaded on the carriage 42, the print controlling unit 51 reads out the cartridge data stored in the storage unit 15 and 26 of the ink cartridges 10 and 20, writes in the storage unit 15 and 26 of the respective cartridges 10 and 20 data capable of specifying the point of time of loading, and then determines whether or not the cartridges 10 and 20 are refilled products in accordance with the data on the number of refilling.

In a case where the cartridges are new, the ink in the ink cartridges 10 and 20 is filled in the recording head 46 under default conditions to start print processing. On the other hand, in a case where it is determined that the cartridges are refilled products, the data in the data storage unit 55 is adjusted or updated on the basis of the cartridge data stored in the storage unit 15 and 26, and the ink is filled in the recording head 46.

As to the amount of consumption of the ink in the ink cartridges 10 and 20 due to the printing operation, the prevention of clogging, and the like, when an ink end is detected at a predetermined period, e.g., at a point of time when the printing of a series of print data has been finished, or at a point of time when the turning off of the power has been instructed by the software switch, the print controlling unit 51 stores in the storage unit 15 and 26 of the cartridges 10 and 20 data capable of specifying as cartridge data the time when the ink end occurred.

The containers of the ink cartridges 10 and 20 in which the ink has been consumed by printing and which have been used are collected through retailers. Those ink cartridges 10 and 20 which became reusable by the filling of the ink in the containers are recirculated as recycled cartridges, and those cartridges whose degree of wear is excessive and which cannot obtain predetermined print quality even if the ink is refilled are melted and are reutilized as a raw material.

Figure 7:
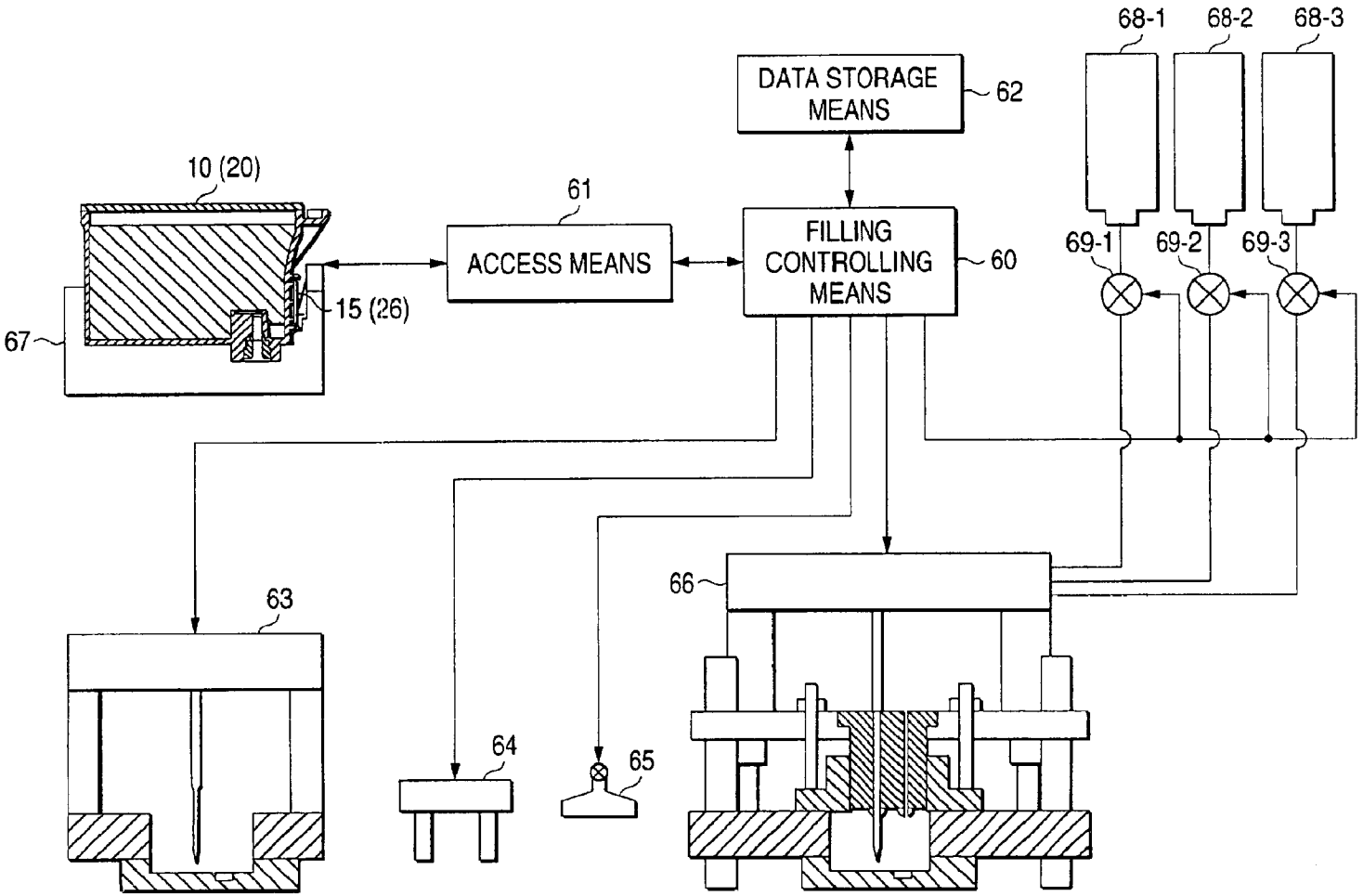
FIG. 7 is a diagram illustrating an embodiment of an apparatus for refilling ink in an ink container.

FIG. 7 illustrates an embodiment of an ink filling apparatus for filling ink in the cartridges which were collected after having been used, which is one kind of a recording material filling apparatus. A filling controlling unit 60 reads out data from the storage unit 15 and 26 of the collected ink cartridges 10 and 20 by an access unit 61, and fills the ink by controlling an ink discharging unit 63, a part replacing unit 64, a cleaning unit 65, and an ink filling unit 66 in accordance with evaluation data stored in a data storage unit 62. During the ink filling process or upon completion of ink filling, the filling controlling unit 60 allows data on such as driving conditions to be stored in the storage unit 15 and 26 in accordance with the aforementioned evaluation data so that the recording apparatus using the cartridges will be able to effect printing while maintaining prescribed print quality.

Ink storage containers 68-1, 68-2, and 68-3, for example in this embodiment, containers, disclosed in JP-A-10-193635, each of which is constituted such that a flexible bag for accommodating ink is provided with packing adapted to be pierced by a hollow needles, are connected to the ink filling unit via calves 69-1, 69-2, and 69-3 whose opening and closing are controlled by a signal from the filling controlling unit 60.

Referring to the flowcharts shown in FIGS. 8 and 9, a description will be given of the operation of the filling apparatus thus constructed.

Figure 8:
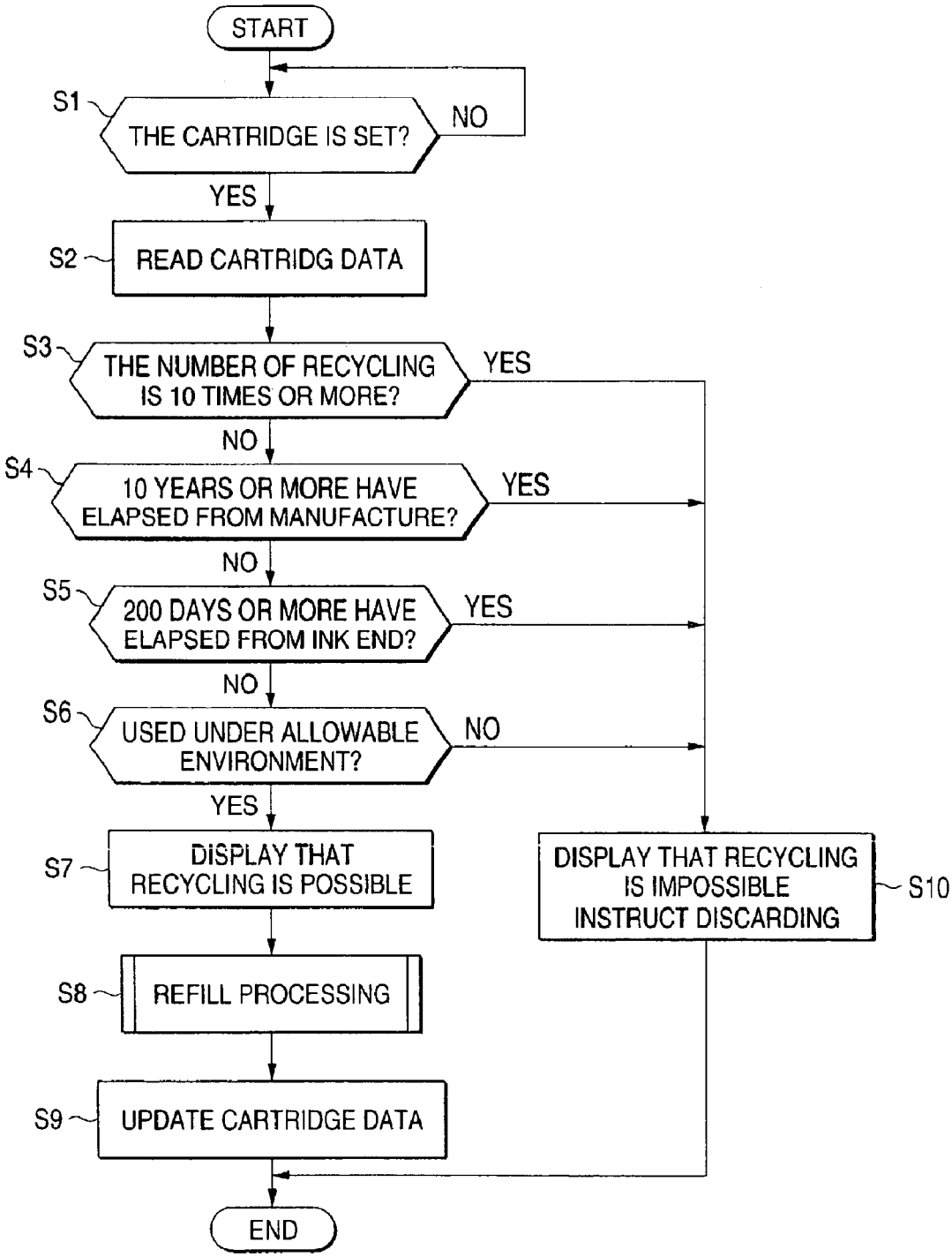
FIG. 8 is a flowchart illustrating the overall operation of the apparatus for refilling ink.

When the ink cartridge 10 is set on an operation pallet 67 (Step S1 in FIG. 8), the filling controlling unit 60 reads out the data in the storage unit 15 and 26 through the access unit 61 (Step S2 in FIG. 8), and determines the conditions including whether or not the number of the refilling of the ink cartridge is within a prescribed number of times, e.g., 10 times (Step S3 in FIG. 8), whether or not the period of time elapsed after manufacture is within a prescribed period, e.g., 10 years (Step S4 in FIG. 8), whether or not the period of time elapsed from a most recent ink end is within a prescribed period, e.g., 200 days (Step S5 in FIG. 8), and whether or not the state of use of the relevant cartridge was within the range of the environment prescribed by the manufacturer (Step S6 in FIG. 8). If all the items are satisfied, it is determined that reuse is possible, and this result is displayed (Step S7 in FIG. 8), and the operation proceeds to a refilling process (Step S8 in FIG. 8).

On the other hand, if any one of the conditions for usability as a result of refilling is not satisfied, or with respect to the cartridge which does not satisfy a plurality of conditions, a display is given to the effect that reuse is impossible, and the discarding of the relevant cartridge is instructed (Step S10 in FIG. 8). The cartridge 10, 20 which thus satisfied the requirements for refilling are set on the pallet 67 in the above-described refilling process. If the elapsed period of time from the point of time of the previous ink filling and the elapsed period of time from the point of time when the ink end occurred are shorter than prescribed values, the cartridge is transferred as they are to the ink filling unit 66, which will be described later.

Figure 9:
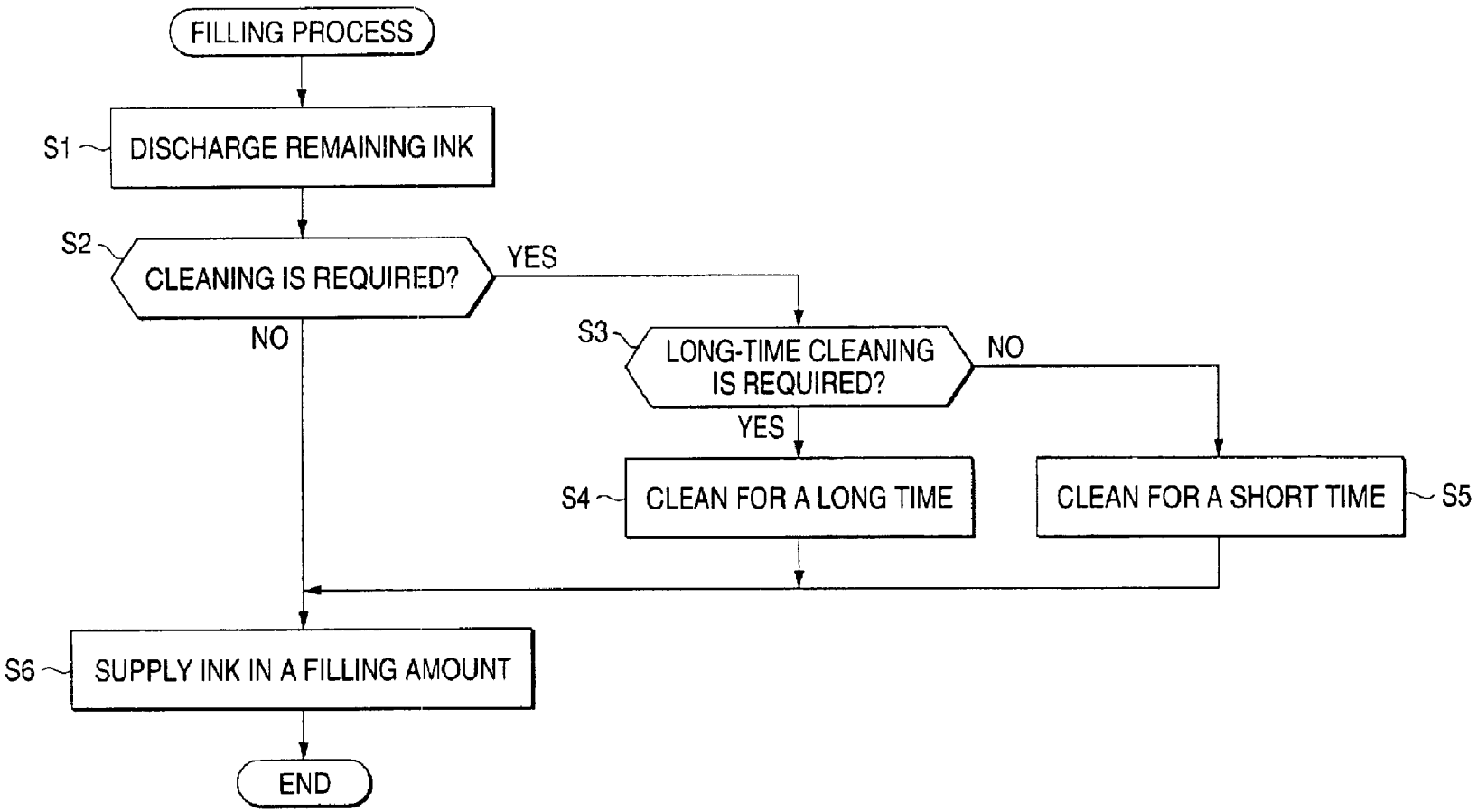
FIG. 9 is a flowchart illustrating a filling process of the apparatus for refilling ink.

On the other hand, if the elapsed period of time from the point of time of the previous ink filling and the elapsed period of time from the point of time when the ink end occurred are longer than prescribed values, the cartridge is transferred to the ink discharging unit 63, and the remain of the ink inside the cartridge is discharged by suction or the like (Step S1 in FIG. 9). Then, a determination is made as to whether or not cleaning is necessary by taking into consideration the elapsed period of time from the most recent ink end (Step S2 in FIG. 9). The time duration of cleaning by the cleaning unit 65, i.e., the degree of cleaning, is determined in accordance with the relative duration of the period of time (Steps S3 to S5 in FIG. 9).

Upon completion of the preparatory process, such as ink discharging and cleaning, which is necessary for the refilling of the ink, the filling controlling unit 60 fills a predetermined amount of ink in the cartridge on the pallet 67 (Step 56 in FIG. 9). Particularly in a case where the ink is filled in the ink cartridge 20 for color inks, one of the plurality of ink storage containers 68-1, 68-2, and 68-3 is selected and the amount of ink to be filled is determined on the basis of the data stored in the storage unit 26.

Namely, as is known, in the printing of a color image, the amounts of the respective inks are not consumed uniformly, and variations occur in the amounts of consumption of the respective colors. Accordingly, the amounts of filling are adjusted such that when the ink of any color in the ink cartridge 20 for color inks has been used up and printing has become impossible, the other inks of less consumed colors is be consumed. Namely, in the state in which the ink cartridge is shipped from a factory as a new product, inks are filled uniformly in prescribed amounts. In the second filling and thereafter, the amounts of inks are adjusted so as to be less than the above-mentioned prescribed amounts in accordance with the mode of use of the recording apparatus by the user. In the case of the ink whose consumption is extremely small, the additional filling is unnecessary. Nevertheless, to cope with the increased viscosity due to the drying and the like of an ink solvent, it is preferable to fill the ink after slightly discharging the ink up to an amount which permits filling.

Consequently, it becomes possible to lower the cost by optimizing the amounts of inks in the cartridge for color inks, and to facilitate recycling by decreasing as much as possible the amounts of inks remaining unused.

It should be noted that, as for the cartridge 10 for the black ink as well, with respect to the cartridge which has been collected after loading after the expiration of the term when the cartridge can be left as it is in a state of being loaded on the carriage, the ink can be filled only in the amount used during that period, thereby making it possible to optimize the amount of the ink and lower the recycling cost.

It should be noted that, in the case of an ink cartridge filled with a pigment ink, since the degree of precipitation of the pigment differs according to the elapsed time from the date of manufacture or the date of previous refilling, it is preferable to effect refilling by taking the degree of precipitation into consideration. That is, in the case where the period of time from the previous ink filling is long, a method in which the pigment is dispersed by imparting ultrasonic vibrations after pouring a solvent or a method in which an ink containing a small amount of pigment is filled is selected, for example.

Upon completion of the ink filling, the filling controlling unit 60 stores necessary information in the storage unit 15 and 26 of the refilled ink cartridges 10 and 20 (Step S9 in FIG. 8), including the following cartridge data:

(1) the date of refilling, (2) the total amount of ink after refilling, (3) the number of refilling, (4) the presence or absence of parts replacement, and parts names, (5) as necessary, a method of ink filling in the recording head due to an increase of the number of refilling, data on the amount of ink sucked, information concerning whether or not the filled ink is usable for initial filling, i.e., the degree of deaeration, and the manufacturing lot number of the filled ink, and (6) preferably, useful information concerning the recording apparatus for which the ink cartridge is used, e.g., information itself on the recording paper or a new model, or URL data of a home page, a telephone number, and a facsimile number through which that information can be obtained.

In addition, upon completion of the reading of data from the storage unit 15 and 26, if the data to be rewritten after filling, e.g., the data on the amount of ink, is changed to prescribed data irrespective of the amount of the ink, the speed of the data updating operation after filling (Step 9 in FIG. 9) can be made fast.

It should be noted that in a case where the capacities of the storage unit 15 and 16 are insufficient in recording the information (6) listed above, or in a case where the storage unit 15 and 16 are broken, it is desirable to replace the storage unit with those having large storage capacities.

As the necessary information is thus stored in the storage unit 15 and 26 of the ink cartridges 10 and 20, even in the case of the recycled ink cartridge with ink refilled, its history becomes clear, and the quality of characters printed by the recording apparatus can be ensured by the data concerning the change of the mode of driving of the recording apparatus due to the difference with a new product.

On the other hand, in a case where the inks in the ink storage containers 68-1, 68-2, and 68-3 have been consumed, the ink storage containers 68-1, 68-2, and 68-3 are replaced for replenishment.

It should be noted that although, in the above-described embodiment, a description has been given of the refilling of ink in the cartridge in which the leakage of ink is prevented by impregnating the porous member with ink, it is evident that the invention is also applicable to the filling of ink in an ink cartridge in which, as disclosed in JP-A-8-174860, a valve which noarmally maintains a closed state and is opened by the negative pressure due to the ink consumption by the recording head is disposed between an ink storage chamber and an ink supply port.

Figure 10:
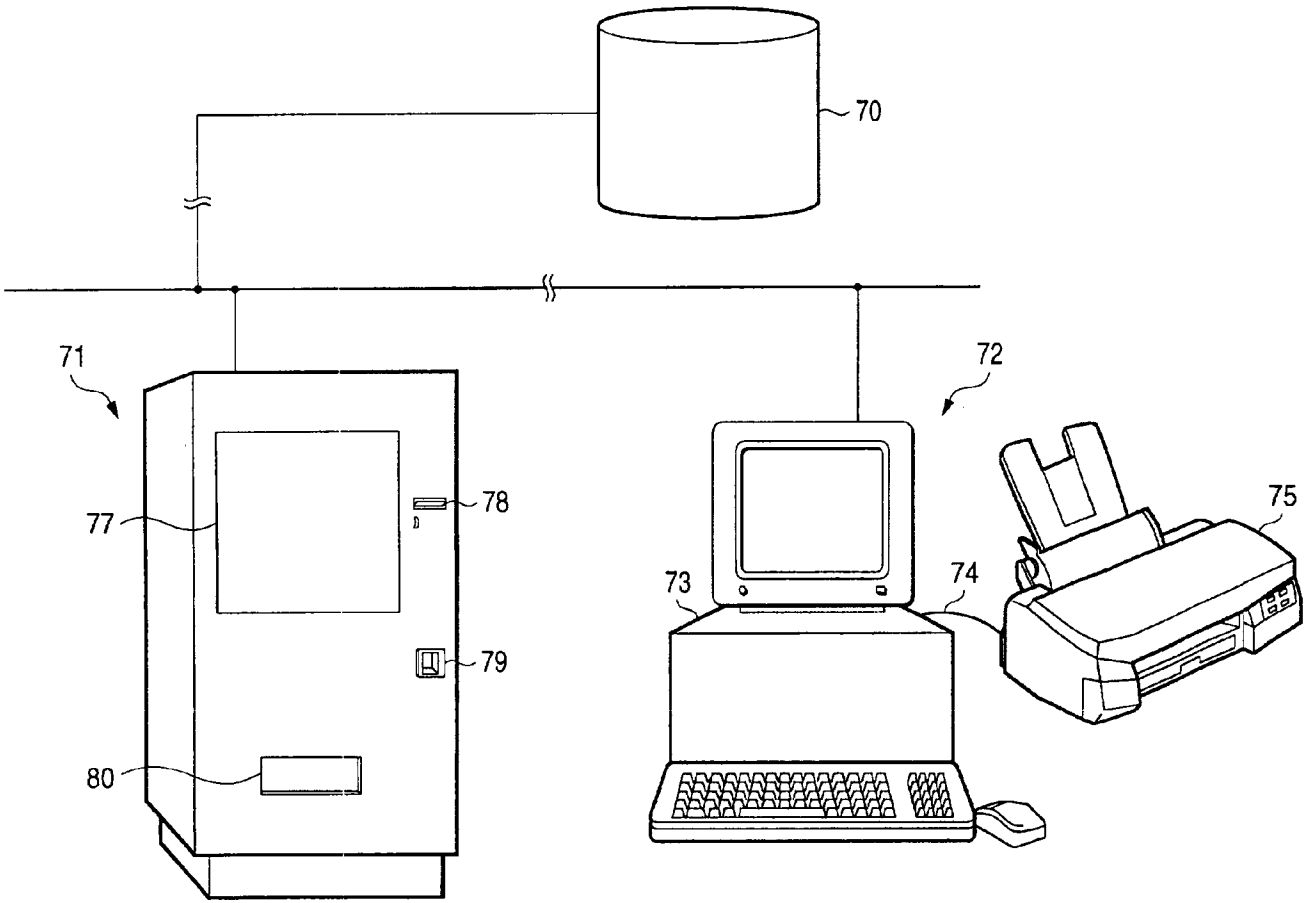
FIG. 10 is a schematic diagram illustrating an embodiment in which the ink filling technique is applied to an ink vending machine.

FIG. 10 illustrates an example of an ink vending machine making use of the above-described cartridge refilling technique, and this ink vending machine is constituted by a server system 70 for managing the sale of ink and an ink vending machine 71. It should be noted that a printer 72 is constituted by a local computer 73 and an ink jet recording apparatus 75 connected thereto by a LAN line 74 or the like.

The ink vending machine 71 includes an input unit 76 (see FIG. 11), a display unit 77, a fee receiving portion 78, a change returning portion 79, and a cartridge insertion port 80.

Figure 11:
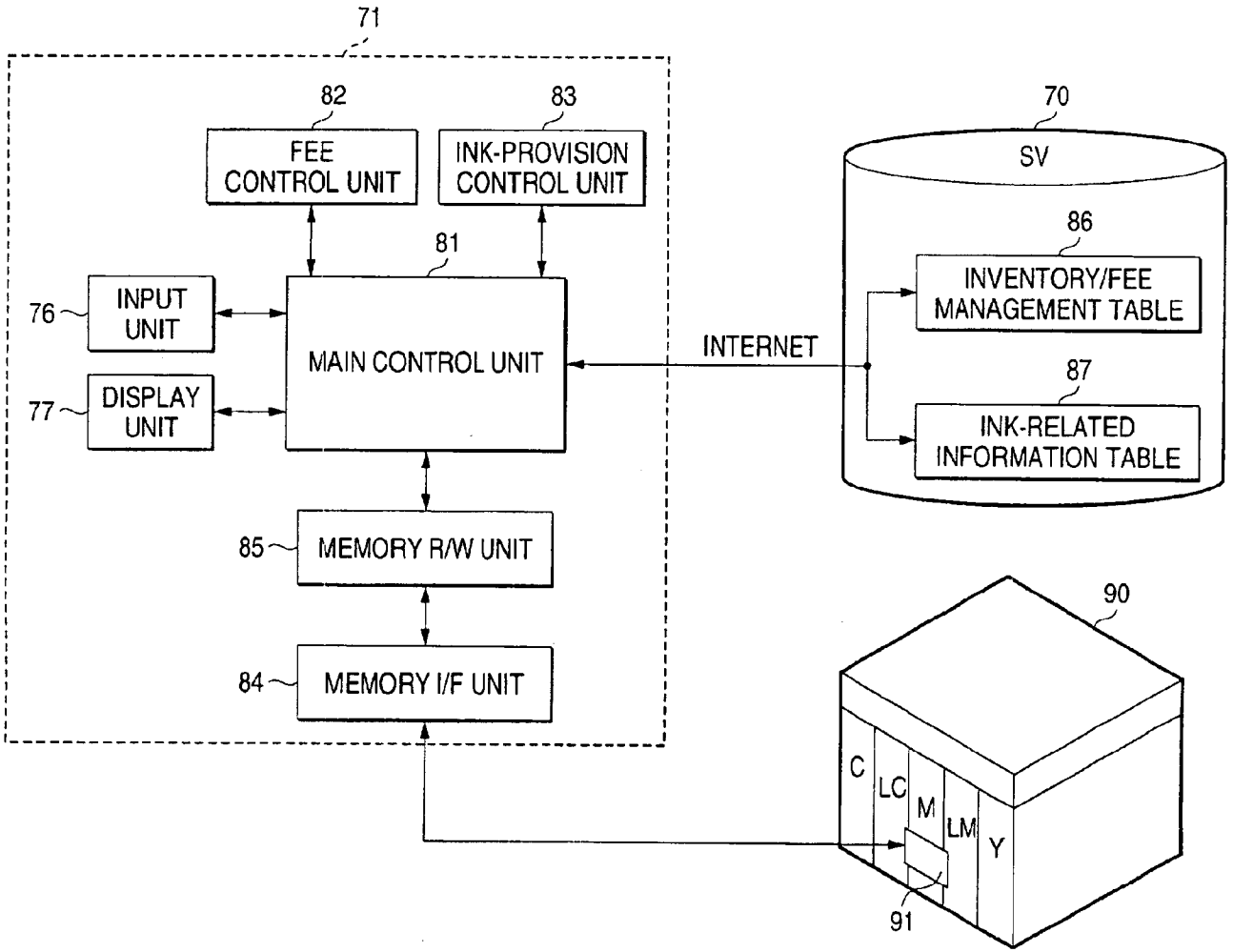
FIG. 11 is a block diagram illustrating an embodiment of the ink vending machine.

As shown in FIG. 11, the ink vending machine 71 is constituted by a main control unit 81, the input unit 76 making up a user interface, the display unit 77, a fee control unit 82 for controlling the calculation and receipt of a fee of the ink, an ink-provision control unit 83 for controlling the replenishment, replacement and change of the ink, a storage unit interface unit 84 connected to storage unit 91 and 91' of cartridges 90 and 90' which will be described later, and a storage-unit read/write unit 85.

The main control unit 81 is connected to the server system 70 via the Internet, and manages and supports the supply of ink by the ink vending machine 71. Specifically, on the basis of the data of an inventory/fee management table 86, the server system 70 effects inventory control of the inks (e.g., the inks stored in the ink storage containers 68-1 to 68-3 shown in FIG. 7) stored in the ink vending machine 71 and sets fees of the inks. In addition, the server system 70 provides information on the inks to be sold as new products, for example, in a form in which the firmware of the recording apparatus can be upgraded.

The input unit 76 is configured as a touch panel which is integrally formed with the display unit 77 in this embodiment, and transmits to the main control unit 81 an input by the user to the ink vending machine 71. The display unit 77 displays the remaining amounts of ink inside the ink cartridge, the contents of input by the user, and other information so as to support the input operation by the user.

The storage-unit read/write unit 85 is connected via the storage unit interface unit 84 to the storage unit 91 and 91' provided on the ink cartridges 90 and 91'. The storage-unit read/write unit 85 reads out the remaining amounts of ink and other information stored in the storage unit 91 and 91', and writes therein information instructed by the main control unit 81 to write.

Referring to the flowchart shown in FIG. 12, a description will be given of the operation of the ink vending machine thus constructed.

The user loads the ink cartridge 90 or 90' to be refilled in a suitable cartridge loading portion of the cartridge insertion port 80 (Step S1). The cartridge loading portion corresponds to a recording material container loading unit. In the ink vending machine 71, a plurality of cartridge loading portions are provided so as to be able to cope with various types of cartridges. A cartridge loading portion can be easily selected by, for example, inputting the model number of the ink cartridge to the ink vending machine 71 or by designating the model number of the ink cartridge which appeared on the display unit 77 functioning as a touch panel.

Figure 13:
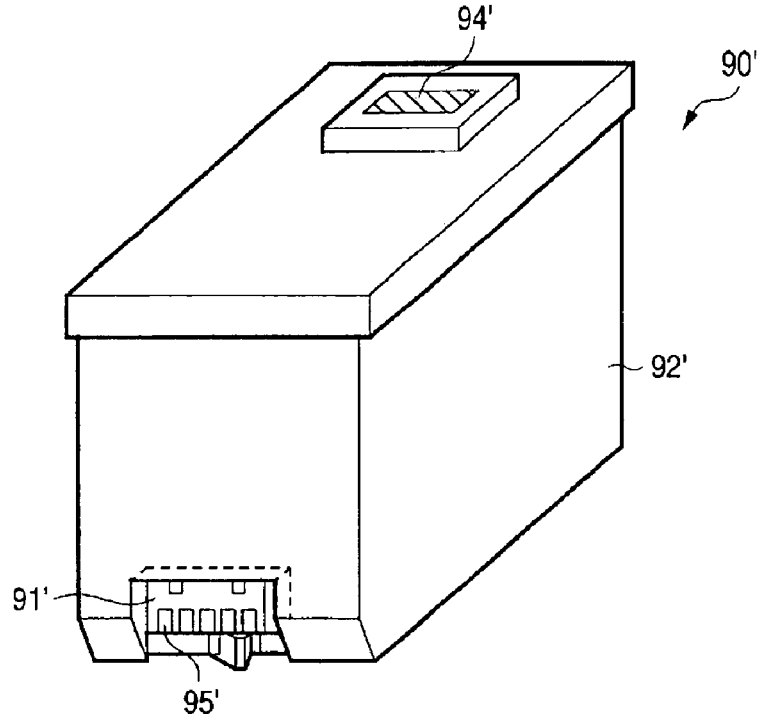
FIGS. 13(*a*) and 13(*b*) are perspective views illustrating examples of the ink cartridge and a cartridge loading unit.
Figure 13:
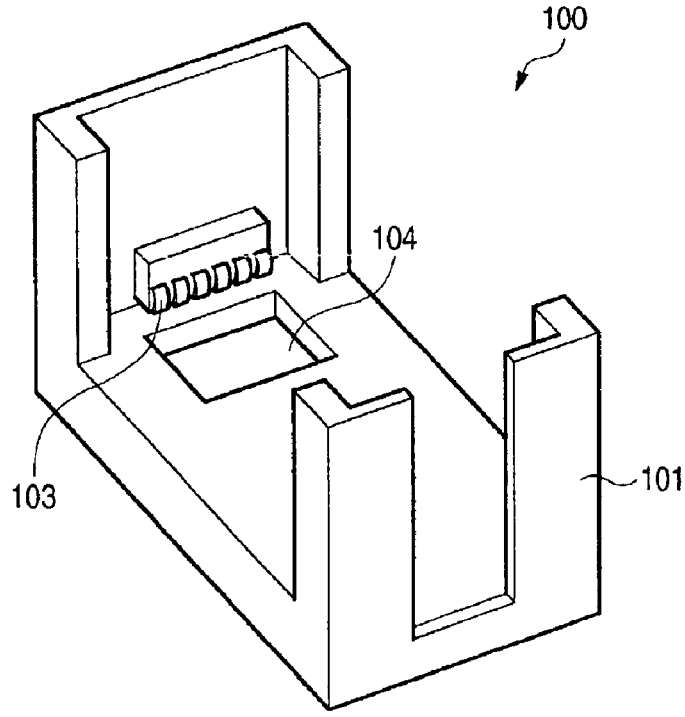

FIG. 13 illustrates an embodiment of the cartridge 90' for black ink. In a cartridge body 92' accommodating a black ink, an ink supply port 93' engageable with the recording apparatus is formed, and an ink filling port 94' is formed at a position where engagement with the vending machine is facilitated, i.e. on an upper surface in this example. Further, connecting terminals 95' and the nonvolatile storage unit 91' capable of electrically rewriting data are provided at a position where connection to an external circuit is facilitated.

A cartridge loading unit 100 is arranged such that a fixing lever 102 capable of being opened and closed is provided on a holder 101 for setting the ink cartridge 90' at a predetermined position where the filling of ink is facilitated. Inside the holder 101, contacts 103 for connecting to the connecting terminals 95' of the storage unit 91' of the cartridge 92' are arranged, and an opening 104 for accommodating the ink supply port 93' is formed.

First, if the user inputs information specifying the model of the ink cartridge 90' to the ink vending machine 71, the cartridge loading unit 100 which matches the relevant ink cartridge 90' is exposed in the cartridge insertion port 80 (FIG. 10).

Figure 14:
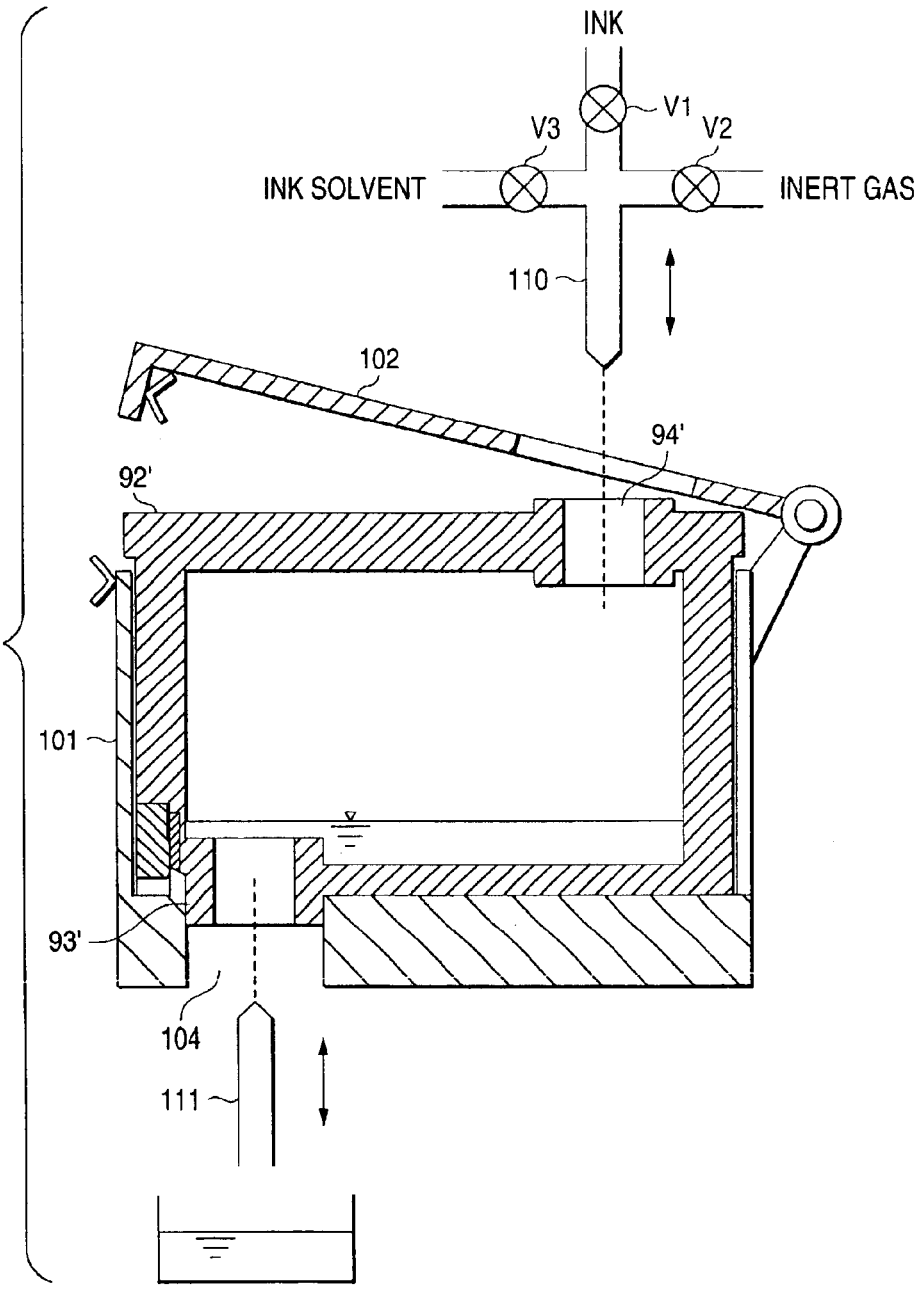
FIG. 14 is a cross-sectional view illustrating the embodiment of the ink cartridge and the cartridge loading unit.

In this state, the fixing lever 102 of the cartridge loading unit 100 is opened, as shown in FIG. 14, and the ink cartridge 90' is loaded in the cartridge loading unit 100 in a predetermined manner. Then, when the lever 102 is closed, the connecting terminals 95' of the storage unit 91' of the ink cartridge 90' are connected to the contacts 103 of the cartridge loading unit 100.

As a result, the storage-unit read/write unit 85 reads from the storage unit 91' the data to be used for the supply of ink (Step S2).

As shown in FIGS. 15 and 16, the storage unit 91' has regions for storing five types of data in large classification. Data 210 concerning the manufacture of the ink cartridge 90 is stored in a first region, data 220 concerning the use of the ink cartridge is stored in a second region, data 310 concerning the numbers of replenishment, replacement, and change of the ink is stored in a third region, ink-related data 320 is stored in a fourth region, and information 330 on the working environment of the ink cartridge of the printer 72 is stored in a fifth region.

It should be noted that, in this embodiment, the replenishment of the ink refers to additionally filling the ink of the same type without discharging the ink remaining in the ink cartridge, the replacement of the ink refers to filling the ink of the same type after discharging the ink remaining in the ink cartridge, and the change of the ink refers to filling the ink of a different type after discharging the ink remaining in the ink cartridge.

The data 210 concerning the manufacture of the ink cartridge 90 includes data on the model of the ink cartridge 90, data on the period of manufacture, data on a manufacturing line, data on a serial number, and data on the capacity of each ink tank in the cartridge. These items of data are data which are used mainly for determining whether or not the supply of ink to these ink cartridges 90 and 90' is possible.

The data 220 concerning the use of the ink cartridge includes data indicating the remaining amount of each ink in the cartridge, data on the period of opening the cartridge, and an order placement flag.

The data indicating the remaining amount of ink, together with the data on the capacity of each ink tank, is used for calculating a fillable amount of ink. This fillable amount of ink can be-used to allow an appropriate amount of ink to be determined and poured by the ink vending machine 71. The data on the period of opening the cartridge is data which is used for estimating the deterioration of the ink, and is constituted by the data for specifying the period of loading in the recording apparatus 20. The order placement flag has recorded therein a state concerning whether or not a placement of an order with the return of the cartridge has already been made on the precondition of the return of the cartridge 90 or 90'. When such a placement order has been made, the ink vending machine 71 refuses the filling of the ink.

The data 310 concerning the numbers of replenishment, replacement, and change of the ink includes data indicating how many times the ink cartridge underwent the ink replenishment and the like in the past, as well as data indicating the fillable number of times. These items of data are for preventing malfunctions and ensuring print quality by limiting the numbers of times of filling and the like of the ink within fixed ranges.

The ink-related data 320 includes information on the type of ink accommodated in each ink tank and the effective period of the ink. The information on the type of ink is mainly used for specifying the ink to be filled in the replenishment and replacement of the ink. The effective period of the ink is used to allow the user to determine whether the cartridge is to be replenished with the ink or whether all the ink is to be replaced.

The information 330 on the working environment of the ink cartridge of the printer 72 includes, in this embodiment, recording apparatus ID for specifying the model of the recording apparatus 75 in which the ink cartridge 90 or 90' was finally used, information on the operating system of the computer 73 to which the recording apparatus 75 is connected, printer driver information indicating the type and version of a printer driver, and firmware information indicating the type and version of the firmware of the recording apparatus. These items of information are used for determining whether or not a change of the type of ink is possible.

It should be noted that, in this embodiment, the "information on the working environment of the ink cartridge" is information which is used when a determination is made as to whether or not the ink after the change can be used properly by the recording apparatus 75 in which that cartridge is used. Generally, the information on the working environment of the ink cartridge includes at least part of information indicating the type of software (printer driver) for generating print data from image data and information indicating the types of hardware (i.e., the recording apparatus) and software (i.e., the firmware of the recording apparatus) for executing printing by using the generated print data.

A determination is made by the main control unit 81 as to whether or not the ink filling by the ink vending machine 71 is possible (Step S3). In this determination, if a determination is made that ink filling is impossible on the basis of the fact that whether or not the numbers of times of replenishment, replacement, and change of the ink cartridge performed is not more than limiting values, a display is given on the display unit 77 to the effect that the ink cannot be filled (Step S8).

On the other hand, if it is determined that ink filling is possible or if ink filling is impossible only with respect to some ink cartridge(s), a display is given to that effect, and the main control unit 81 displays the remaining amounts of ink for the respective ink tanks on the display unit 77 (Step S4).

Figure 17:
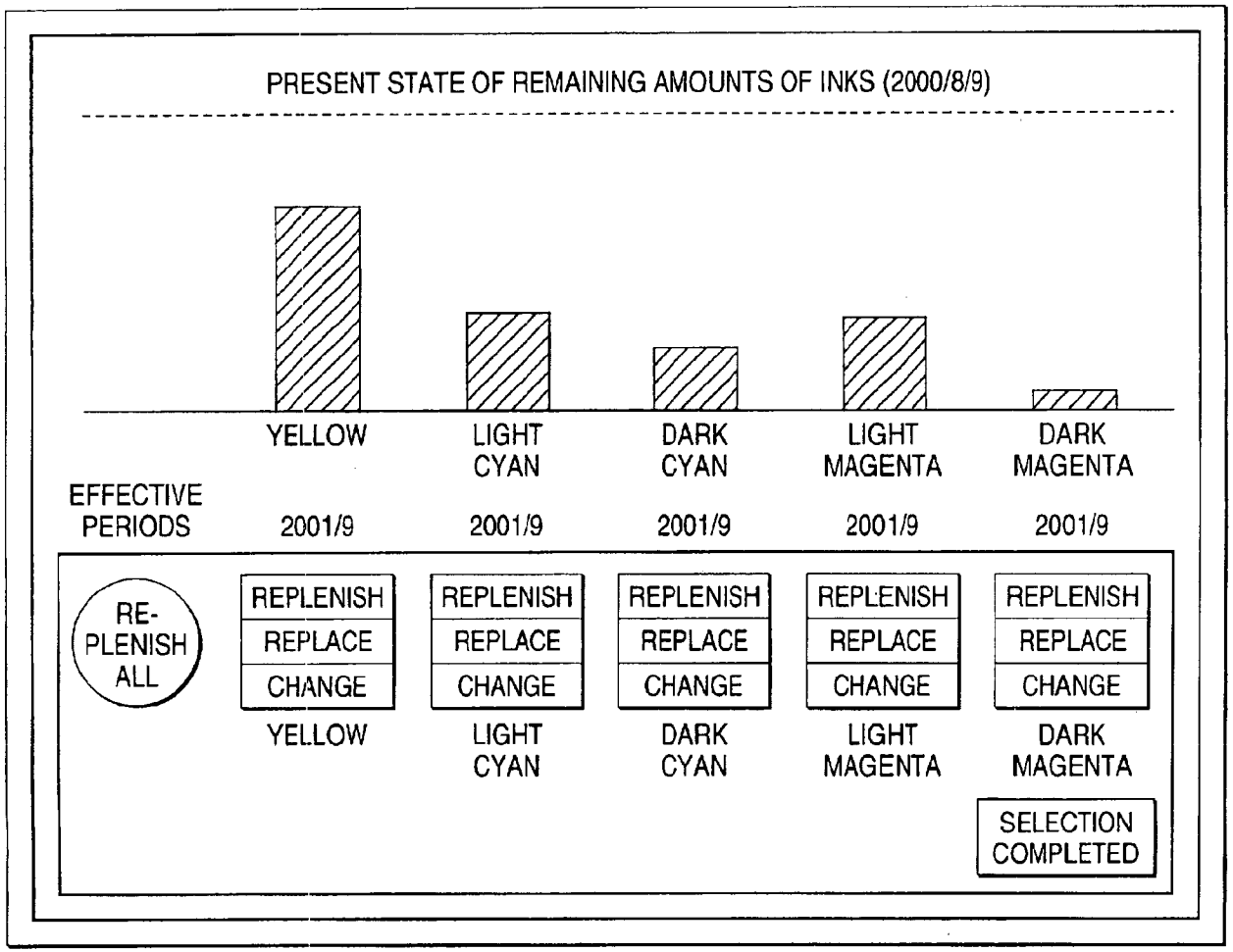
FIGS. 17 and 18 are schematic diagrams respectively illustrating embodiments of information on the remaining amounts of inks and the like which are displayed on the ink vending machine.

FIG. 17 shows a state in which the display unit 77 displays the remaining amounts of ink for the respective ink tanks in the cartridge 90 for color inks. According to this display, the user is able to determine that what form is to be taken to fill the ink by taking the remaining amounts of ink into consideration. This determination includes, for example, a determination as to whether the ink is to be replenished or replaced and a determination as to in what amount the ink is to be replenished.

The user selects which of the replenishment, replacement, and change of the ink in each of the ink tanks of the ink cartridge 90 is to be provided (Step S5). This selection is determined by the user by taking the present state of the remaining amounts of inks into account, as described above.

Figure 18:
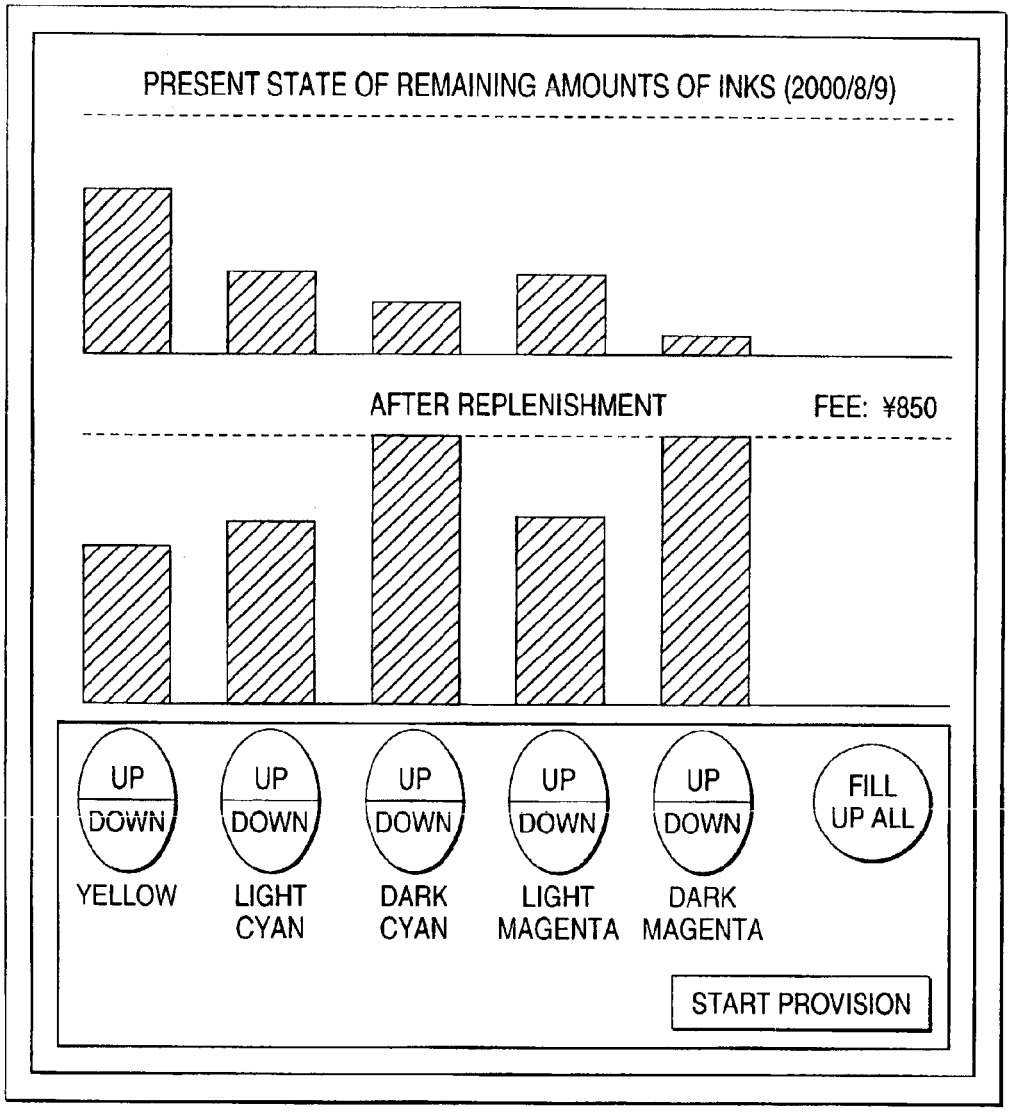

For example, as shown in FIG. 17, as for light magenta and dark magenta, since 1 year remains as the effective period, it is considered desirable to select replenishment, and as for light cyan and dark cyan, since the expiration of the effective period is approaching, it is considered desirable to select replacement. Incidentally, in a case where the user desires the replenishment of all the inks, "REPLENISH ALL" is selected. Upon completion of this selection, if the user touches the display of "SELECTION COMPLETED" on the input unit 76, the results of selection are inputted to the main control unit 81. FIG. 18 shows a state in which "REPLENISHMENT" has been selected for the ink tanks of the cartridge 90.

However, in a case where the change of ink has been selected, the following process is performed before proceeding to Step S6. In this process, a determination is first made as to whether or not printing can be effected properly by using the ink after change in the working environment of the ink cartridge of the printer 72 for which the irk cartridge 90 was finally used. This determination is made on the basis of information which specifies the type and form of software for generating data for controlling the ejection of ink, such as the printer driver of the computer 73 and the firmware of the recording apparatus 75. This is because there are cases where the working environment of the ink cartridge does not conform depending on the type of the ink. For example, in the case of a newly sold ink, there are cases where unless a printer driver of a new version is used, a change can occur in the tone of color, possibly making it impossible to effect printing with high image quality equivalent to that of the original ink.

In a case where the ink after change cannot be poured as a result of this determination, a display is given to that effect, and a display which prompts selection between replenishment and replacement is given again on the display unit 77. It should be noted that in a case where the working environment of the ink cartridge can conform if it is changed by upgrading the version or by some other method, a display to that effect is given on the display unit 77, and an inquiry as to whether selection is to be made between replenishment and replacement is displayed again. The determination as to whether or not the working environment of the ink cartridge can conform is made on the basis of the information for specifying the model of the recording apparatus 75. For example, in the case of the recording apparatus of a type in which firmware has been installed in a nonvolatile storage unit which is capable of rewriting, and in a case where the capacity of the nonvolatile storage unit is sufficient with respect to the firmware after the upgrading of its version, a determination is made that conformity can be obtained.

The state of the remaining amounts of inks at the present time and the state of the remaining amounts of inks after replenishment are shown in an upper portion of the display unit 77 in the form such as the one shown in FIG. 18. The display of "UP/DOWN" below each column representing the remaining amount functions as the input unit 76 for setting the state of the remaining amount of ink after replenishment.

As for the amount of ink after replenishment, replacement, or change of the ink, if the user touches, for instance, the portion "UP" of light cyan, the column of light cyan in the column graph extends upward, and the fee increases. Thus it is possible to set the amount of ink after the replenishment, replacement, or change while confirming the fee. Incidentally, all the ink tanks of the ink cartridge are to be filled up, it suffices if the display of "FILL UP ALL" is touched (Step S6). Upon completion of the setting, the display of "START PROVISION" on the input unit 76 is touched. If this is done, the result of the setting is inputted to the main control unit 81, and the operation proceeds to Step S7.

Figure 19:
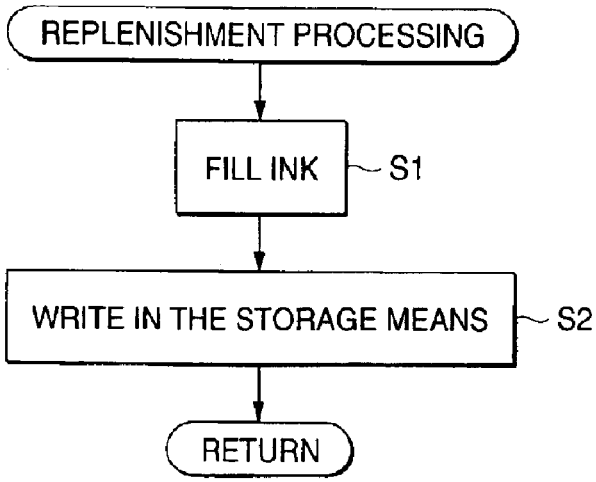
FIGS. 19(*a*) and 19(*b*) are flowcharts respectively illustrating the operation of the ink vending machine.
Figure 19:
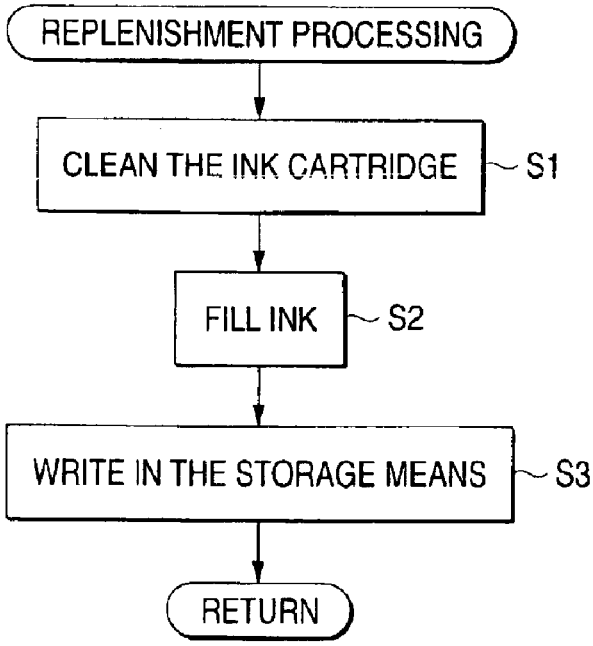

In the operation of ink replenishment, ink of the same type is additionally filled without discharging the ink remaining in the ink cartridge (Step S1 in FIG. 19(*a*)). The process of ink filling is effected in a state in which a filling needle 110 (FIG. 14) is lowered and inserted in the ink tilling port 94', while a discharge needle 111 (FIG. 14) is raised and inserted in the ink supply port 93'. At this time, the discharge needle 111 is deeply inserted such that its tip reaches a vicinity of an upper end of the interior of the ink tank 92'. Next, a valve V1 is opened, and the ink of the same type as that of the ink remaining in the ink tank is filled through the filling needle 110 in an amount which has been set, and the air remaining in the ink tank is vented through the discharge needle 111.

It should be noted that, at this time, by taking into account the evaporation of the solvent in the ink after the opening of the ink cartridge, prior to the filling of the ink a valve V3 may be opened, and the solvent of the ink may be poured through the filling needle 110 in a prescribed amount, e.g., an amount commensurate with the period of time elapsed from the opening of the ink cartridge 90.

Upon completion of the filling of the ink, information concerning ink filling and information on such as the remaining amount of ink after replenishment and the number of replenishment, replacement, or change are written in the storage unit 91 (Step S2 in FIG. 19(*a*)). Upon completion of writing in the storage unit 91, the filling needle 110 and the discharge needle 111 are withdrawn, the ink cartridge 90 is ready to be removed, and a display to that effect is given on the display unit 77, so that the user is able to remove the ink cartridge 90 from the holder 101.

Next, referring to the flowchart in FIG. 19, a description will be given of the operation of filling ink of the same type after discharging the ink remaining in the ink cartridge, i.e., the replacement of ink.

Initially, the cleaning of the ink tank of the ink cartridge 90 is carried out (Step S1 in FIG. 19(*b*)). In this cleaning, the filling needle 110 (FIG. 14) is lowered and inserted in the ink discharge port 94', while the discharge needle 111 is raised and inserted in the irk supply port 93'. At this time, the discharge needle 111 is inserted shallowly so as to reach a vicinity of a bottom surface of the ink cartridge 92' (FIG. 14).

Next, a valve V2 is opened, and an inert gas such as nitrogen is filled through the filling needle 110 to drive the ink remaining in the tank through the discharge needle 111 by applying pressure thereto. The valve V3 is opened, and the solvent of the ink is filled through the filling needle 110 to clean the interior of the ink tank 92'. Furthermore, the valve V2 is opened, and a gas is charged to discharge the solvent of the ink through the discharge needle 111.

At the stage when foreign substances in the ink tank 92' have been discharged, the valve V1 is opened, and the filling of ink is started (Step S2 in FIG. 19(*b*)). The filling of the ink is effected in a state in which the discharge needle 111 is deeply inserted such that its tip reaches an upper portion of the inner space of the ink tank 92', i.e., a position higher than the liquid level of the ink to be filled.

Upon completion of the filling of the ink, in addition to the information on the filled ink and information on the remaining amount of ink after replenishment and the number of replenishment, replacement, or change, information on the effective period of the ink is written in the storage unit 91 (Step S3 in FIG. 19(*b*)).

The procedure of the operation of filling the ink of a different type after discharging the ink remaining in the ink cartridge, i.e., the change of ink, is executed by a procedure substantially similar to that of the above-described ink replacement. However, the difference lies in that, in the recording operation of the storage unit 91 after the ink filling, data concerning the type of ink is changed to the type of ink which has been filled.

As described above, in accordance with this embodiment, by merely installing the ink vending machines in convenience stores and the like, the users are able to fill the ink in the used ink cartridges at nearby places, so that the collection operation by the manufacturer is made unnecessary, and the reuse of the ink cartridges can be promoted. In addition, the users are able to receive the supply of ink at low fees.

Figure 12:
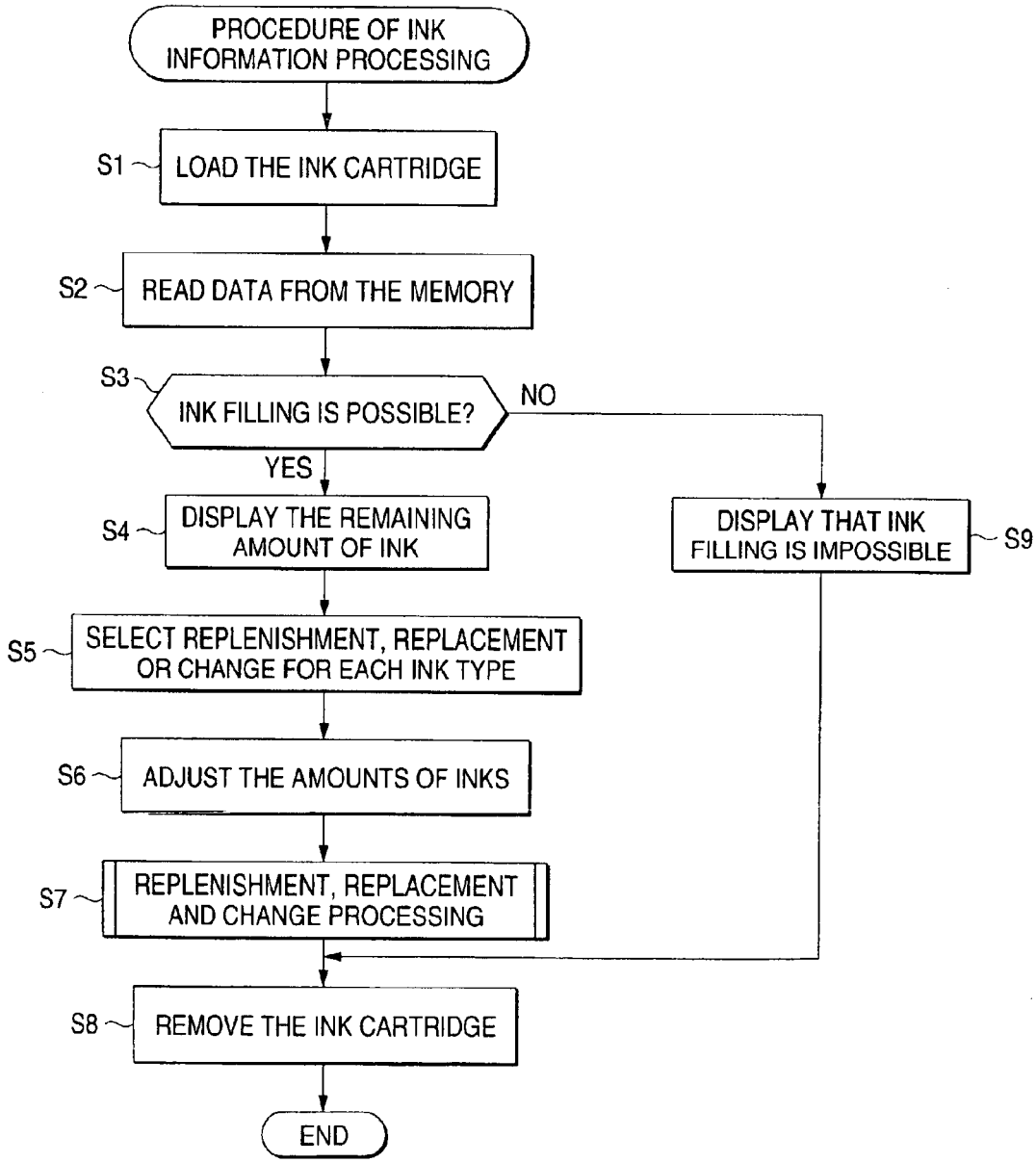
FIG. 12 is a flowchart illustrating the operation of the ink vending machine.

It should be noted that although, in the above-described embodiment, the setting operation for filling the ink into the cartridge is performed at the ink vending machine, processing in Steps S2 to S6 in the flowchart shown in FIG. 12 maybe effected by the local computer 73, and the result may be stored in the storage unit 91 of the ink cartridge. In this case, the setting is carried out by directly using the inventory/fee management table 86 and an ink-related information table 54 of the server system 70. Thus, if the color ink cartridge 90 having the storage unit 91 in which the data for filling is stored is loaded in the ink vending machine 71, the ink vending machine 71 reads out the data from the storage unit and effects the subsequent control. Therefore, it is possible to fill desired inks in the cartridge without forcing the user to effect the setting operation at the ink vending machine, and it is possible to attain the simplification of the ink vending machine and improvement of the operating rate of the ink vending machine.

Incidentally, in the above embodiments, the description is described with reference to the ink cartridge, the ink filling apparatus and a method of filling the ink in the ink cartridge. However, the present invention can be applied to a laser printer, for example. In the case of the laser printer, a toner cartridge and a toner filling apparatus are employed as the recording material container and the recording material filling apparatus, respectively, and toner which is recording material is filled in the toner cartridge by the toner filling apparatus.

As described above, in the invention, the amount of ink to be filled and the type of ink can be optimized on the basis of the data of the storage unit of the ink cartridge, the reuse of the cartridge is facilitated, and a reduction of cost incidental to recycling can be attained.

What is claimed is:

1. A method of filling a recording material in a recording material container in response to a user's request, comprising the steps of:

receiving the request;

filling the recording material in the recording material container in response to the request; and receiving a counter value corresponding to an amount filled.

2. The method according to claim 1, wherein the recording material container is one of an ink cartridge and a toner cartridge.

3. A recording material filling apparatus for filling a recording material in a refillable recording material container in response to a user's request, comprising:

a recording material container loading unit for loading the recording material container;

a request input unit for inputting the request from an outside; and a recording material filling unit for filling the recording material in the recording material container in response to the request.

4. The apparatus for filling a recording material container according to claim 3, wherein the recording material filling unit is arranged to fill the recording material in the recording material container after the recording material remaining in the recording material container is discharged.

5. The apparatus for filling a recording material container according to claim 3, wherein after the recording material remaining in the recording material container is discharged, the recording material filling unit fills a recording material of a type different from that of the discharged recording material in the recording material container.

6. The apparatus for filling an recording material container according to claim 3, wherein the recording material container is provided with a storage unit for storing working environment information in a state in which the recording material container is loaded in a recording apparatus, wherein the information from the storage unit is displayed on a display unit, the recording material filling unit determines whether or not an recording material of a different type can be used in the recording apparatus on the basis of the working environment information, and a result thereof is displayed on the display unit.

7. The apparatus for filling a recording material container according to claim 6, wherein the storage unit stores information for specifying a recording apparatus in which the recording material container is loaded, and the recording material filling unit determines whether or not recording material of a different type can be used in the recording apparatus on the basis of the information for specifying the recording apparatus, and a result of the determination is displayed on a display unit.

8. The apparatus for filling a recording material container according to claim 6, wherein the storage unit stores a number of filling the recording material in the recording material container, and the recording material filling unit determines whether or not the recording material can be filled in the recording material container on the basis of the number of filling prior to the filling of recording material, and the number of filling stored in the storage unit is updated after the filling of the recording material.

9. The apparatus for filling a recording material container according to claim 3, wherein the recording material container is provided with a storage unit which stores information for specifying a fillable amount of the recording material, and the recording material filling unit fills the recording material in the recording material container within a range of the fillable amount.

10. The apparatus for filling a recording material container according to claim 9, wherein the storage unit stores the number of filling the recording material in the recording material container, and the recording material filling unit determines whether or not the recording material can be filled in the recording material container on the basis of the number of filling prior to the filling of recording material, and the number of filling stored in the storage unit is updated after the filling of the recording material.

11. The apparatus for filling a recording material container according to claim 3, wherein the request includes filling amount information for specifying a recording material filling amount which has been arbitrarily set by said user, and the recording material filling unit fills the recording material in the recording material container in accordance with the filling amount information.

12. A recording material filling apparatus for filling a recording material in a container in response to a user's request, comprising:

the recording material filling apparatus according to claim 3; and a server system for effecting at least one of management of an amount of recording material to be filled in the recording material filling apparatus, upgrading of data on a recording material provision fee, and provision of support information for allowing the recording material filled in the cartridge to be useable in a recording apparatus.

13. The apparatus according to claim 3, wherein the recording material container is one of an ink cartridge and a toner cartridge.

* * * * *